United States Patent [19]

Norwood

[11] 4,281,520

[45] Aug. 4, 1981

[54] PORTABLE COOLER FOR BOTTLED BEVERAGES

[76] Inventor: Donald D. Norwood, 1261 Crescent Ter., Sunnyvale, Calif. 94087

[21] Appl. No.: 112,360

[22] Filed: Jan. 15, 1980

[51] Int. Cl.[3] ..... F25D 3/08; F25D 11/00

[52] U.S. Cl. ..... 62/372; 62/430; 62/457

[58] Field of Search ..... 62/371, 372, 457, 430, 62/529, 530; 220/4 E, 9 F; 206/545

[56] References Cited

U.S. PATENT DOCUMENTS

| | | | |
|---|---|---|---|
| 296,432 | 4/1884 | Moebius | 62/457 |
| 1,843,055 | 1/1932 | Weinstein | 62/457 |
| 3,282,068 | 11/1966 | Cain | 62/457 |
| 3,365,911 | 1/1968 | Stoner et al. | 62/457 |
| 3,434,302 | 3/1969 | Stoner et al. | 62/457 |
| 3,802,220 | 4/1974 | Pompo | 62/430 |
| 3,998,072 | 12/1976 | Shaw | 62/372 X |
| 4,197,890 | 4/1980 | Simko | 62/372 X |

FOREIGN PATENT DOCUMENTS

| | | | |
|---|---|---|---|
| 678418 | 3/1930 | France | 62/457 |

*Primary Examiner*—Lloyd L. King
*Attorney, Agent, or Firm*—Thomas Schneck

[57] ABSTRACT

A pair of hollow modules, each containing a liquid refrigerant, are shaped to fit around the circumference, bottom and neck of a beverage bottle. The neck of the bottle protrudes from one end so that the beverage can be poured without removal from the cooler. The cooler has an inner curvature which fits the curvature of the largest diameter bottle to be accommodated. The modules are held together by a strap with loops at each end which fit around the pair of modules and into grooves or rings on the outer surface thereof.

6 Claims, 8 Drawing Figures

PORTABLE COOLER FOR BOTTLED BEVERAGES

BACKGROUND OF THE INVENTION

1. Field of the Invention

The present invention relates to cooling apparatus and more particularly to a portable cooler for keeping a beverage bottle cool.

2. Description of Prior Art

On many occasions it is desirable to take a chilled bottled beverage on an outing to be enjoyed over a period of time which may span as much as eight to ten hours. To enable this, a portable refrigerating device is desired which: (a) avoids the messiness of ice; (b) is not bulky or excessively weighty as are cooling boxes and similar appliances; (c) maintains near-refrigerator temperatures over the duration of the outing; (d) is conveniently portable; (e) accommodates the large variety of bottle sizes found in today's market, and which (f) is inexpensive to manufacture.

There is a need for a self-contained, portable device for cooling and maintaining a bottled beverage cool. The device should also be able to hold various sizes and shapes of bottles without substantial loss in cooling efficiency. Furthermore, the device should allow one to open and use the bottle without having to remove the bottle from the cooler.

Prior approaches to solving the problem of keeping bottled beverages cool are illustrated in the following patents.

Shaw, U.S. Pat. No. 3,998,072 discloses a portable wine cooler having removable capsules which are filled with a refrigerant. A retaining ring of a fixed size holds the capsules in a space between the ring and the outer walls of the cooler. A handle is provided on the cooler for portability. In this patent, the cooler does not adjust to various sized bottles and the bottle must be removed from the cooler for pouring the contents.

The Stoner U.S. Pat. No. 3,365,911 discloses capsules which are shaped to the contour of the largest bottle to be chilled and are held in a holder which allows the capsules to adjust to smaller sized bottles. The capsules do not completely surround the bottle as it is desirable in this type of device to leave the label exposed for viewing. Furthermore, the device is not designed for portability.

The Kane U.S. Pat. No. 3,282,068 discloses a refrigerant filled pouch held onto a bottle to be chilled by means of two rubber straps. The device will fit various sized bottles because the straps are elastic. The pouch is not designed to enclose the bottle and it is possible that on smaller bottles the straps might slip off, especially when the bottle is wet from condensation. Furthermore, the straps do not provide a means by which the cooler can be carried.

The Stoner U.S. Pat. No. 3,434,302 shows a bottle chiller in which capsules are placed in a container which has a spring to hold a bottle against the capsules which are free to move to accommodate various sized bottles. The spring takes up approximately one third of the circumference of the bottle so that with this design the capsules cannot completely surround the bottle.

It is therefore an object of this invention to provide a portable cooling device for bottled beverages which fits a wide range of sizes of bottles in a manner which maximizes cooling efficiency across this size range to achieve low temperature maintenance over extended time periods and incorporates a design in which the cooling mechanism, the container and the carrying device are cooperative and function as a single unit, thus offering significant economy in manufacture.

A further object of the invention is to provide a portable cooling device for beverage bottles which allows the beverage to be poured without removing the bottle from the device.

A further object of the invention is to provide a cooling device for bottles which is small, light weight and has means by which the device may be carried.

BRIEF SUMMARY OF THE INVENTION

Briefly, the above objects are accomplished in accordance with the invention by providing a pair of hollow cooling modules, each being insulated or containing a liquid refrigerant and being shaped such that when placed together the modules substantially surround the circumference, bottom and neck portion of a beverage bottle. The inner surface of the modules has a curvature which fits the curvature of the largest diameter bottle to be accommodated.

A unique design feature allows the cooling modules to fit snugly around small bottles as well as large bottles, enabling direct physical contact between bottle and modules over a wide range of bottle sizes, thereby promoting maximum cooling efficiency. An opening in the neck portion of the modules allows the neck of a bottle to protrude therefrom.

The outer surface of the pair of modules is circular in shape and is provided with strap restraining means, such as one or more annular grooves cut into the outer surface and/or rings, through which a strap may pass.

The modules are held together by a strap having adjustable slip-loops at each end thereof. The loops are wrapped around the pair of modules and engage the strap restraining means to thereby secure the pair of modules around the bottle and to provide a carrying strap between the two loops.

In accordance with an aspect of the invention a bag is provided, made of flexible fabric of a size to fit the circumference of the pair of modules when surrounding the largest diameter bottle to be accommodated. The bag has an opening therein to receive the cooling device and openings in the middle of the bag through which the carrying strap is drawn to thereby hold the bag onto the pair of modules, the strap providing the means by which the bag-module-bottle combination may be transported.

The invention has the advantage that the cooling device fits a wide range of bottle sizes in a manner which achieves efficient cooling for the various bottle sizes. Considering the large variety of bottle sizes on the market today, the significance of this feature can be readily appreciated.

The invention has the further advantage that the cooling mechanism, container and carrying device act as one unit, effecting economy of manufacture and simplicity of use.

BRIEF DESCRIPTION OF THE DRAWINGS

The foregoing and other objects, features and advantages of the invention will be apparent from the following detailed description of various embodiments of the invention, as illustrated in the accompanying drawings wherein.

DESCRIPTION OF THE PREFERRED EMBODIMENT

Figure 1:
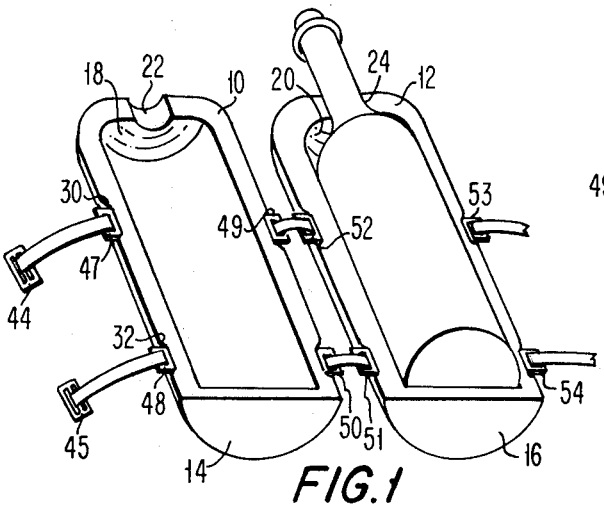
FIG. 1 is a perspective view of the cooling device of the present invention in the open position.
Figure 2:
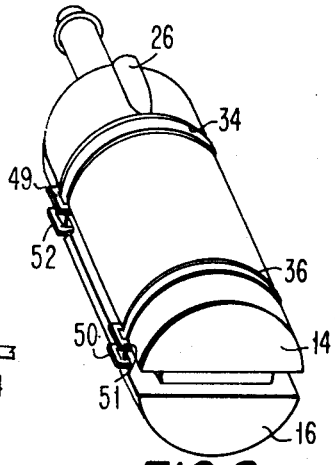
FIG. 2 is a perspective view of the cooling device of the present invention in the closed position.
Figure 6:
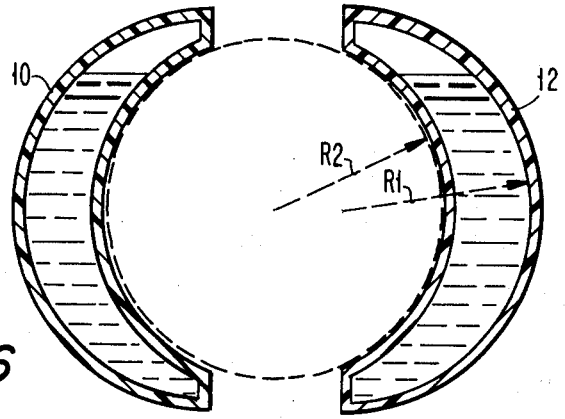
FIG. 6 is a view in section illustrating the fit around the largest bottle.
Figure 7:
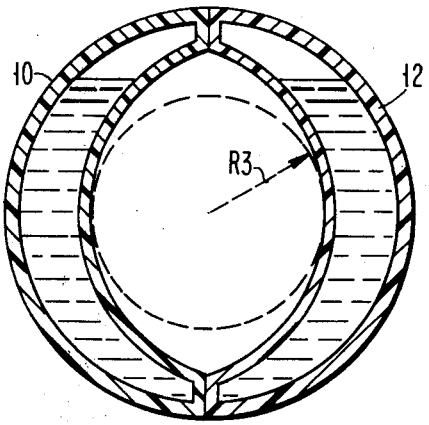
FIG. 7 is a view in section illustrating the fit around the smallest bottle.

Referring now to FIG. 1, two identical modules, 10, 12 are shaped with an outer surface which describes one half of a semicircle so that when the modules are placed together their combined surfaces form a cylindrical surface. The inner surface is shaped to the contour of a beverage bottle, the radius (R2) of the arcuate surface being that of the largest bottle to be accommodated. This radius R2 is offset (refer to FIG. 6) such that the inner surface presents to the bottle a surface which is somewhat less curved than the outer surface. This design feature enables direct physical contact along a vertical line from the bottom of the bottle to the top of the cooler for a broad size range of conventionally shaped (cylindrical) bottles (for example from conventional 25.4 oz. wine bottles to 67.6 oz (2 liter) soft beverage bottles) allowing highly efficient cooling by direct conduction. The extent of offset between inner and outer radii is exactly equal to difference in the radii of the largest and smallest bottle to be accommodated (i.e., R2-R3, FIGS. 6 and 7).

The potential for utilizing inner and outer curved surfaces having parallel curvature is also contemplated by this invention. The essence of this design feature relates to the cooperative nature of the design aspects of the modules; their use in conjunction with each other and the harness mechanism which insures that both modules are held in direct contact with the bottle across a wide range of bottle sizes. One end, 14, 16, of each module forms a vertical bottom portion to contact the bottle at the bottom and to hold the bottle in the device.

Figure 8:
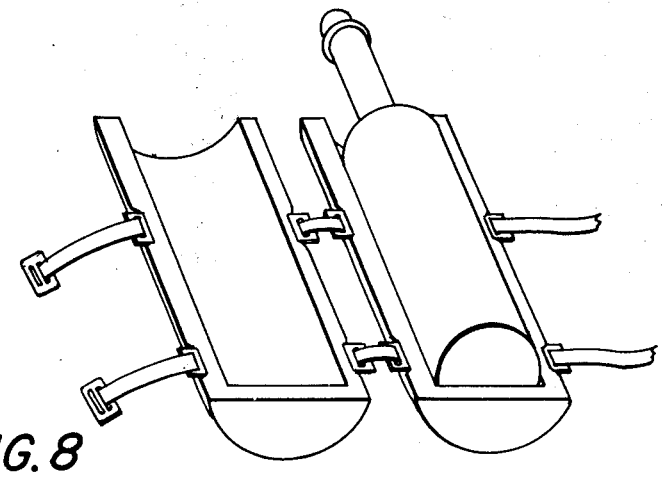
FIG. 8 is a perspective view of a second embodiment of the invention.

The other end, 18, 20, of each module forms a neck portion with an opening 22, 24, therein through which the neck of the bottle protrudes. Alternately, as shown in FIG. 8, the vertical rise of the halves may be terminated at the beginning of the curvature which forms the shoulders. This design allows withdrawal of the bottle without release of the strap harness.

The modules are hollow so that they can hold a refrigerant liquid which is introduced into the bottle through funnel portions 26, 28, which are sealed by plugs after the liquid refrigerant has been poured inside.

This refrigerant liquid may be chosen from a wide variety of known mixtures, many involving water and alcohol, which after being frozen use the latent heat of fusion for cooling. A gel refrigerant which may be used is described in U.S. Pat. No. 2,800,454. This material comprises borax and ungelatinized starch dispersed in water which is heated until the starch gels. This material, which is liquid at room temperature, may be frozen within the modules in ordinary home freezers.

The modules are provided with grooves 30, 32, 34, 36, which when the modules are placed together provide two annular grooves around the circumference of the cooling device.

Figure 3:
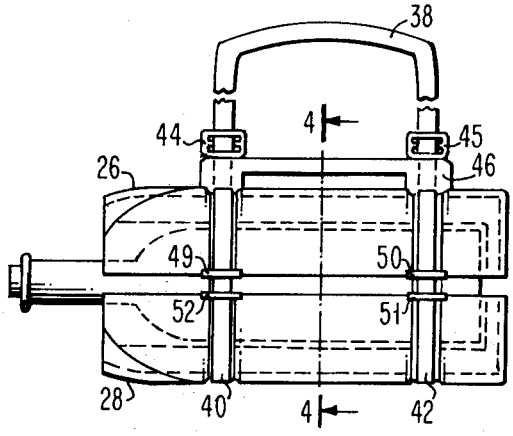
FIG. 3 is a side elevation view of the cooling device of the present invention.

Referring to FIG. 3 the modules are held together by means of a strap 38 provided with a loop, 40, at one end thereof, and a loop, 42, at the other end thereof. The slip loops fit around and hold both halves of the device firmly around the bottle. The loops may be closed by means of movable strap buckles, 44, 45, or stoppers which are slid down the strap as the loops are drawn tight around the device. The strap may be made of leather, cloth, or similar material and also functions as a carrying strap. It should be understood that the loops may also be formed by cutting a hole in the strap at one end and passing the strap material through the hole to form a loop which can be held closed by means of friction.

Figure 4:
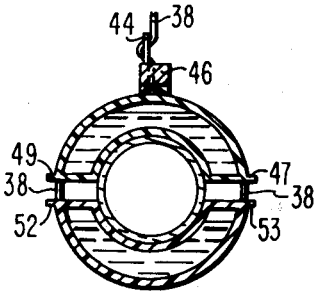
FIG. 4 is a view in section taken along the line 4—4 in FIG. 3.

An optical carrying handle, 46, is shown in FIGS. 3 and 4, through which the strap is passed. Since the strap is adjustable, various sized bottles are held tightly within the device.

It should be understood that when the largest size bottle to be accommodated is placed in the cooler a small space will exist between the two halves of the cooler at the edges. When smaller size bottles are placed in the cooler, the halves fit more tightly together and are drawn tight together by means of the strap.

The invention has the advantage that its use may be continued even after the beverage bottle has been opened and is being consumed. The handle 46 shown in FIG. 3 enables the beverage to be easily poured while the bottle is in the cooler. The flat bottom of the cooler allows the cooler to stand vertically on a flat surface such as a table.

A coating may be applied to the exterior surface, or the entire surface of the modules. Depending upon the properties of the coating chosen, it may serve the purpose of eliminating condensation, be decorative, provide additional insulation, and/or act as a protective coating.

As an alternative or an addition to the annular grooves, the strap may be held in place around the modules by means of rings 47, 48, 49, 50, 51, 52, 53, 54, which serve the purpose of keeping the straps from slipping off of the modules. These rings are particularly useful when the modules are opened as shown in FIG. 1. In this case, the rings serve to provide a hinged portion between the two halves of the device, so that the modules do not fall away when the device is opened.

FIG. 4 is a sectional view of the cooler taken along the section lines 4—4 of FIG. 3. In this view it is clearly seen how a large bottle is accommodated by the device and how the contour of the inner surface of the device is shaped to fit the contour of the bottle.

Figure 5:
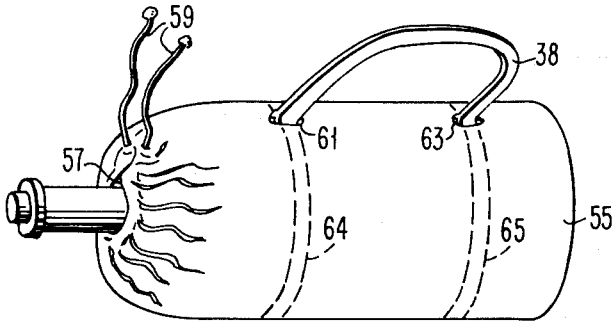
FIG. 5 is a side view of the cooling device placed within a bag in accordance with the present invention.

Referring now to FIG. 5, a bag 55 may be provided of a shape to fit snugly around the cooler when the cooler is at its largest size, i.e. when being used with a large bottle. The bag is provided with an opening 57 through which the entire device is passed and which is secured around the neck of the bottle by means of a drawstring 59. Two eyelets, 61, 63, are provided through which the strap, 38, is drawn. The loops at the ends of the strap are secured and drawn tight around the bottle as shown in FIG. 3.

Alternatively, the straps may be laced through sleeve portions 64, 65, sewn into the bag as illustrated by the dotted lines. In this embodiment, one end of the loop may be secured to the bag and the loop is drawn tight around the bottle by pulling the strap 38 tight in the sleeve 64, 65, thus drawing the strap, bag, combination tight around the cooler. This type of construction has the advantage that it makes it easier to remove the bottle from the cooler/bag combination without removing the modules from the bag. This is accomplished by first loosening the drawstring 59, loosening the straps in the sleeves, spreading the modules apart, and then pulling the bottle out of the bag.

While the invention has been particularly shown and described with reference to the embodiments thereof, it will be understood by those skilled in the art that the foregoing and other changes in form and detail may be made therein without departing from the spirit and scope of the invention.

What is claimed is:

1. A bottle cooling device comprising:

a pair of hollow modules, each module being hollow and including refrigerant material therein, each module having an outer arcuate surface forming an outer wall describing the arc of a semicircle, and an inner arcuate surface for engagement with a bottle to be cooled, said inner arcuate surface describing less than the arc of a semicircle and having a curvature which fits the curvature of the largest diameter bottle to be accommodated, such that said modules substantially surround the surface of said bottle to be cooled, each of said modules further having a projecting bottle support portion at the lower end thereof to support the bottom of a bottle, each module further including first and second restraining means on the outer surface thereof adapted to receive a strap; and, a strap having a first adjustable loop at one end thereof and a second adjustable loop at the other end thereof, said first loop being wrapped around said modules in engagement with said restraining means and said second loop wrapped around said modules in engagement with second restraining means, thereby securing said pair of modules around said bottle and providing a carrying strap between said first and second loops.

2. The cooling device in accordance with claim 1 wherein said first and second restraining means comprise annular grooves cut in the surface of said pair of modules.

3. The cooling device in accordance with claim 1 wherein said first and second restraining means comprise rings on the surface of said module through which said strap passes to thereby hold said strap in engagement with the surface of said modules.

4. The cooling device in accordance with claim 1 further comprising:

a bag of flexible fabric of a size to fit the circumference of said pair of modules when expanded to fit the largest diameter bottle to be accommodated, said bag having an opening therein to receive said modules and eyelets therein through which said strap is drawn to thereby hold the bag onto said pair of modules.

5. The cooling device in accordance with claim 4 wherein said bag further includes sleeve portions sewn therein such that the loops at the ends of said strap may be passed through said sleeve portions in said bag, whereby the loop/bag combination may be drawn tight around said modules.

6. The cooling device in accordance with claim 1 wherein said refrigerant material is liquid at room temperature.

* * * * *